US005181504A

United States Patent [19]

Ono et al.

[11] Patent Number: 5,181,504

[45] Date of Patent: Jan. 26, 1993

[54] VIBRATION GENERATOR USING ROTARY BODIES HAVING UNBALANCED WEIGHTS, AND VIBRATORY STIMULATING APPARATUS USING SAME VIBRATION GENERATOR

[75] Inventors: Takahiko Ono; Youichi Endo, both of Tokyo, Japan

[73] Assignees: Ono Sokki Co., Ltd., Tokyo; Kabushiki Kaisha Hayashibara Seibutsu Kagaku Kenkyujo, Okayama, both of Japan

[21] Appl. No.: 494,426

[22] Filed: Mar. 16, 1990

[30] Foreign Application Priority Data

Mar. 20, 1989 [JP] Japan ..... 1-30878[U]

[51] Int. Cl.[5] ..... A61H 1/00

[52] U.S. Cl. ..... 128/36

[58] Field of Search ..... 128/36, 24.1, 34, 32, 128/55, 37

[56] References Cited

U.S. PATENT DOCUMENTS

| | | | |
|---|---|---|---|
| 3,547,109 | 12/1970 | Martin | 128/34 |
| 3,831,591 | 8/1974 | Newkirk | 128/36 |
| 3,896,795 | 7/1975 | Solhkhah | 128/36 |
| 3,919,575 | 11/1975 | Weber | 128/36 |
| 4,258,706 | 3/1981 | Shank | 128/24.1 |
| 4,469,092 | 9/1984 | Marshall | 128/36 |
| 4,535,760 | 8/1985 | Ikeda | 128/36 |
| 4,559,929 | 12/1985 | Hseu | 128/36 |
| 4,570,616 | 2/1986 | Kunz | 128/36 |
| 4,697,581 | 10/1987 | Endo et al. . | |
| 4,813,403 | 3/1989 | Endo . | |
| 5,063,911 | 11/1991 | Teranishi | 128/32 |

FOREIGN PATENT DOCUMENTS

| | | |
|---|---|---|
| 0251801 | 1/1988 | European Pat. Off. . |
| 0298661 | 1/1989 | European Pat. Off. . |
| 58-185224 | 12/1983 | Japan . |
| 58-209355 | 12/1983 | Japan . |
| 60-52827 | 4/1985 | Japan . |
| 60-52828 | 4/1985 | Japan . |
| 60-52850 | 4/1985 | Japan . |
| 2167961A | 1/1986 | United Kingdom . |
| 2167667A | 6/1986 | United Kingdom . |

OTHER PUBLICATIONS

"Characteristics of Vibration-Induced Finger Flexion Reflex and Its Clinical Applications", Yoichi Endo et al., Jikeikai Med. J., 28: 187-192, 1981.

*Primary Examiner*—Robert A. Hafer
*Assistant Examiner*—David J. Kenealy
*Attorney, Agent, or Firm*—Jacobson, Price, Holman & Stern

[57] ABSTRACT

A miniaturized inexpensive vibration generator using rotary bodies having unbalanced weights with no absolute encoders provided on the rotary body driving means. Rotary bodies having unbalanced weights are disposed in an opposed state. Members to be detected are fixed to the rotary bodies so that the members to be detected have a predetermined positional relation with the relative weights and rotation detectors are provided fixedly in the positions close to the loci of the rotational movements of the members to be detected, and adapted to output signals representative of what are detected thereby in the form of pulses each of which is generated every time each of the members to be detected passes the relative rotation detector, i.e., every time each member to be detected is revolved 360°, a phase difference computing element computes a phase difference between the unbalanced weights on the basis of the signals from the rotation detectors.

20 Claims, 4 Drawing Sheets

VIBRATION GENERATOR USING ROTARY BODIES HAVING UNBALANCED WEIGHTS, AND VIBRATORY STIMULATING APPARATUS USING SAME VIBRATION GENERATOR

BACKGROUND OF THE INVENTION

1. Field of the Invention

This invention relates to a vibration generator using rotary bodies having unbalanced weights, and a vibratory stimulating apparatus using the same vibration generator.

2. Description of the Prior Art

When the same rotary bodies having unbalanced weights thereon and disposed in an opposed state are rotated synchronously in the same direction, the centrifugal force occurring due to the unbalanced weights can be obtained as the sum of vectors. Accordingly, if the phase difference between the unbalanced weights on these rotary bodies is changed, the sum of vectors of this centrifugal force changes.

In a vibration generator using rotary bodies having unbalanced weights in which the sum of vectors of centrifugal force is utilized, the level of vibration is regulated by varying a difference in phase of the unbalanced weights on the rotary bodies.

In a prior art vibration generator of this kind, the changing of a difference in phase of the unbalanced weights is done by controlling the electric motors, which are adapted to rotate the rotary bodies and provided with absolute encoders, while detecting and observing the phase of the unbalanced weights on these rotary bodies by the same encoders.

When absolute encoders for detecting and observing the phases of the unbalanced weights on the rotary bodies are used as in a conventional vibration generator of this kind, it is difficult to miniaturize the vibration generator, and this obstructs the application of a vibration generator to various kinds of vibratory stimulating apparatuses, for example, a sound sleep bed and a kneader. Moreover, due to the high price of the absolute encoders, the price of the vibration generator using rotary bodies having unbalanced weights is not reduced.

BRIEF SUMMARY OF THE INVENTION

An object of the present invention is to provide a vibration generator using rotary bodies having unbalanced weights, which avoids the use of absolute encoders, and which can be constructed to smaller dimensions at a low cost.

To achieve this object, the present invention provides a vibration generator using rotary bodies having unbalanced weights, comprising rotary bodies having unbalanced weights and disposed in an opposed state, driving means for rotating the rotary bodies, single-element members to be detected fixed directly or indirectly to the rotary bodies so that these members have a predetermined positional relation with the relative weights, rotation detectors which are provided fixedly in the positions close to the loci of the rotational movements of the members to be detected, and which are adapted to output signals representative of what are detected thereby in the form of pulses each of which is generated every time each of the members to be detected passes the relative rotation detector, i.e., every time each member to be detected is revolved 360°, a phase difference computing element adapted to compute a phase difference between the unbalanced weights on the two rotary bodies on the basis of the signals from the rotation detectors, and rotation controllers adapted to control the rotary body driving means on the basis of a detected phase difference signal from the phase difference computing element so that the phase difference signal reaches a set level.

The present invention also provides a vibratory stimulating apparatus comprising a vibration generator using rotary bodies having unbalanced weights, and a means for applying vibration to a living body, the vibration generator consisting of rotary bodies having unbalanced weights thereon and disposed in an opposed state, driving means for rotating the rotary bodies, single-element members to be detected fixed directly or indirectly to the rotary bodies so that these members have a predetermined positional relation with the relative weight, rotation detectors which are provided fixedly in the positions close to the loci of the rotational movements of the members to be detected, and which are adapted to output signals representative of what are detected thereby in the form of pulses each of which is generated every time each of the members to be detected passes the relative rotation detector, i.e., every time each member to be detected is revolved 360°, a phase difference computing element adapted to compute a phase difference between the unbalanced weights on the two rotary bodies on the basis of the signals from the rotation detectors, and rotation controllers adapted to control the rotary body driving means on the basis of a detected phase difference signal from the phase difference computing element so that the phase difference signal reaches a set level.

The rotary bodies provided with unbalanced weights thereon and disposed in an opposed state are rotated by their respective driving means. Every time the member to be detected on each rotary body is rotated 360°, the relative rotation detector outputs a one-pulse signal representative of this rotation. The signals of rotations from these detectors are inputted at different points in time into the phase difference computing element, and the phase difference between the unbalanced weights on the two rotary bodies is computed as a time difference of the signals of rotations detected, a phase difference signal being outputted from the computing element. The driving means are controlled by the rotation controllers so that this phase difference signal agrees with an arbitrarily set phase difference.

As a result, the unbalanced weights are rotated synchronously with a desired phase difference set therebetween, to cause vibration to occur.

In order to apply the vibration thus obtained to a living body and vibratorily stimulate the same, the vibration produced by the vibration generator using rotary bodies having unbalanced weights according to the present invention may be transmitted to a vibration application member which can support, or be engaged with or fixed to a living body, to vibrate the same.

In order to vibrate such a vibration application member in a living body-supporting state, the vibration generator may be attached to a vibration application member of a suitable shape and suitable dimensions, for example, a flat, box type, cylindrical or spherical vibration application member, and the vibration produced by the vibration generator may be transmitted to the living body when the vibration application member supports the living body.

When the vibration generator and a vibratory member, for example, a diaphragm, which is brought into contact with or attached to a living body when it is used in practice, are connected to each other via, for example, air, carbon dioxide, a liquid, such as water and a pressure oil, or a liquid vibration transfer means, a plurality of living bodies placed in different positions can be stimulated vibratorily at once.

A vibration generator body as a whole of the vibration generator using rotary bodies having unbalanced weights according to the present invention used as a vibration source is not bulky, so that this vibration generator can be built in a material of a suitable shape, for example, a blanket, a thick bedquilt, a kneeling cushion, a matress, a vest, Japanese padded clothes, a belt, a sash, a cap, slippers, shoes, a helmet, a chair, a bed, a mat, a seat, a cushion and a driver's seat so as to enable a part or the whole of a living body to be stimulated vibratorily with effect. Such a vibratory stimulation has an excellent effect in relaxing the muscles of a living body, improving the circulation of the blood, shortening sleep latency, awaking a user, relieving a pain in shoulder tightness, muscular pain, a pain in lumbago, arthritis, rheumatism and asthma and an asthma attack, relaxing the body and mind, and practicing a warmup and giving a message before and after doing sports.

When the head of a living body is stimulated vibratorily by a vibration application member attached thereto, for example, a cap-shaped or helmet-like vibration application member, the vibration of this member causes the skin of the head to be massaged effectively, and produces remarkable effect in promoting the growth and regeneration of hair and preventing fallen hair. It has been discovered that, when a hair restorer "Kanko-soh No. 301" (manufactured by Japanese Research Institute for Photosensitizing Dyes Co., Ltd., Okayama, Japan) is used as necessary during such a head skin vibrating operation, an extremely high hair growing- and hair regeneration-effect can be achieved owing to a synergetic action of the vibratory stimulating effect of the vibration generator according to the present invention and the medical effect of the hair restorer.

If the vibration generator according to the present invention is brought into contact with a living body via an elastic material, for example, sponge, rubber and a plastic foam, the portion of the living body with which the vibration generator is engaged can be stimulated vibratorily with a large force.

In order to practically use the vibratory stimulating apparatus according to the present invention, the apparatus is placed on, for example, a thick bedquilt, a straw mat, a chair, a bed, a floor or ground surface, a sheet are put over the apparatus as necessary, and a living body is set thereon, which may then be vibratorily stimulated; or a vibration application member is brought into contact with or attached to a part to be treated of a living body, which may then be vibratorily stimulated.

The vibration frequency used in this vibratory stimulating operation may be at a level which enables a living body to be stimulated when vibration of the frequency is applied thereto. This vibration frequency is usually about 1–400 Hz, preferably about 10–120 Hz and more preferably about 50–80 Hz or about 100–120 Hz. Vibration of a frequency in such ranges may be applied continuously or intermittently while monitoring the symptom of the living body. In order to apply vibration to a living body intermittently or to shorten the sleep latency, a timer is conventiently employed.

BRIEF DESCRIPTION OF THE DRAWINGS

The above and other objects as well as advantageous features of the invention will become apparent from the following description of the preferred embodiments taken in conjunction with the accompanying drawings wherein.

DETAILED DESCRIPTION

The embodiments of the present invention will now be described with reference to the drawings.

Figure 1:
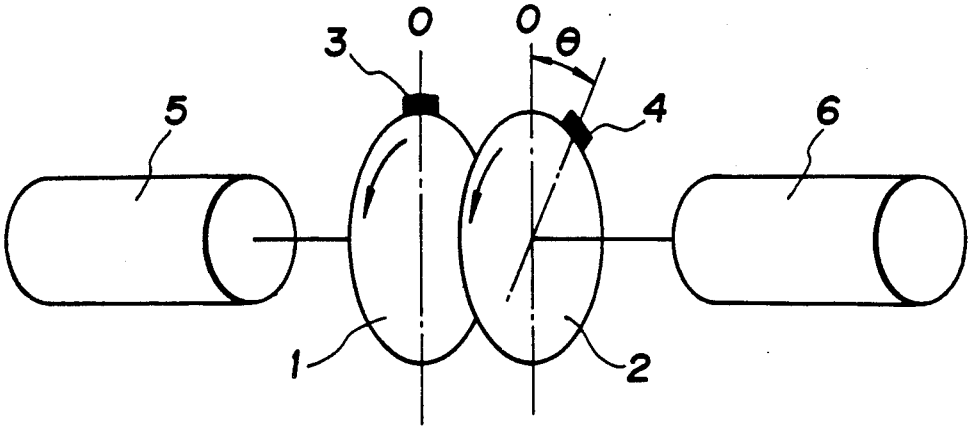
FIG. 1 is a schematic perspective view of an embodiment of the vibration generator using rotary bodies having unbalanced weights according to the present invention.
Figure 3:
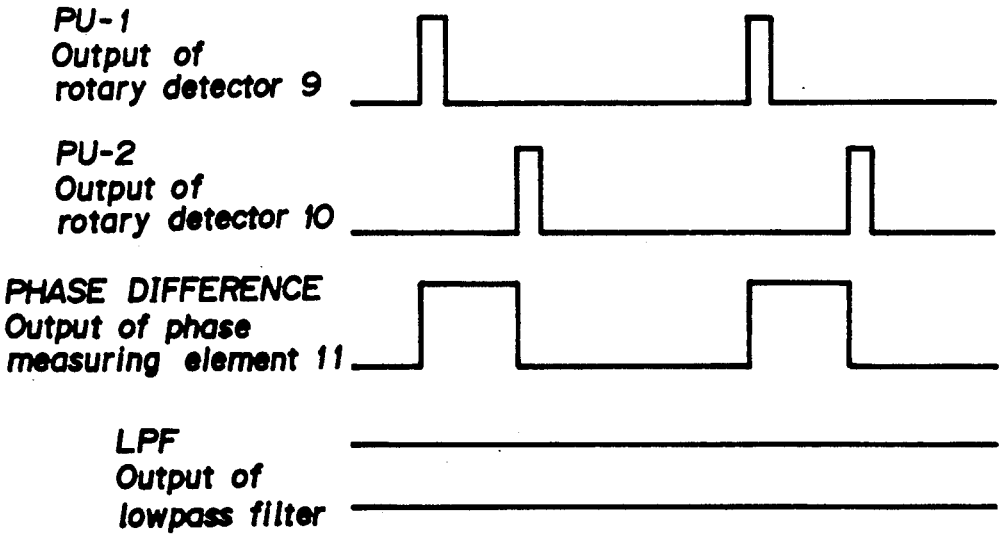
FIG. 3 shows outputs from various parts of the embodiment of the vibration generator using rotary bodies having unbalanced weights according to the present invention.
Figure 2:
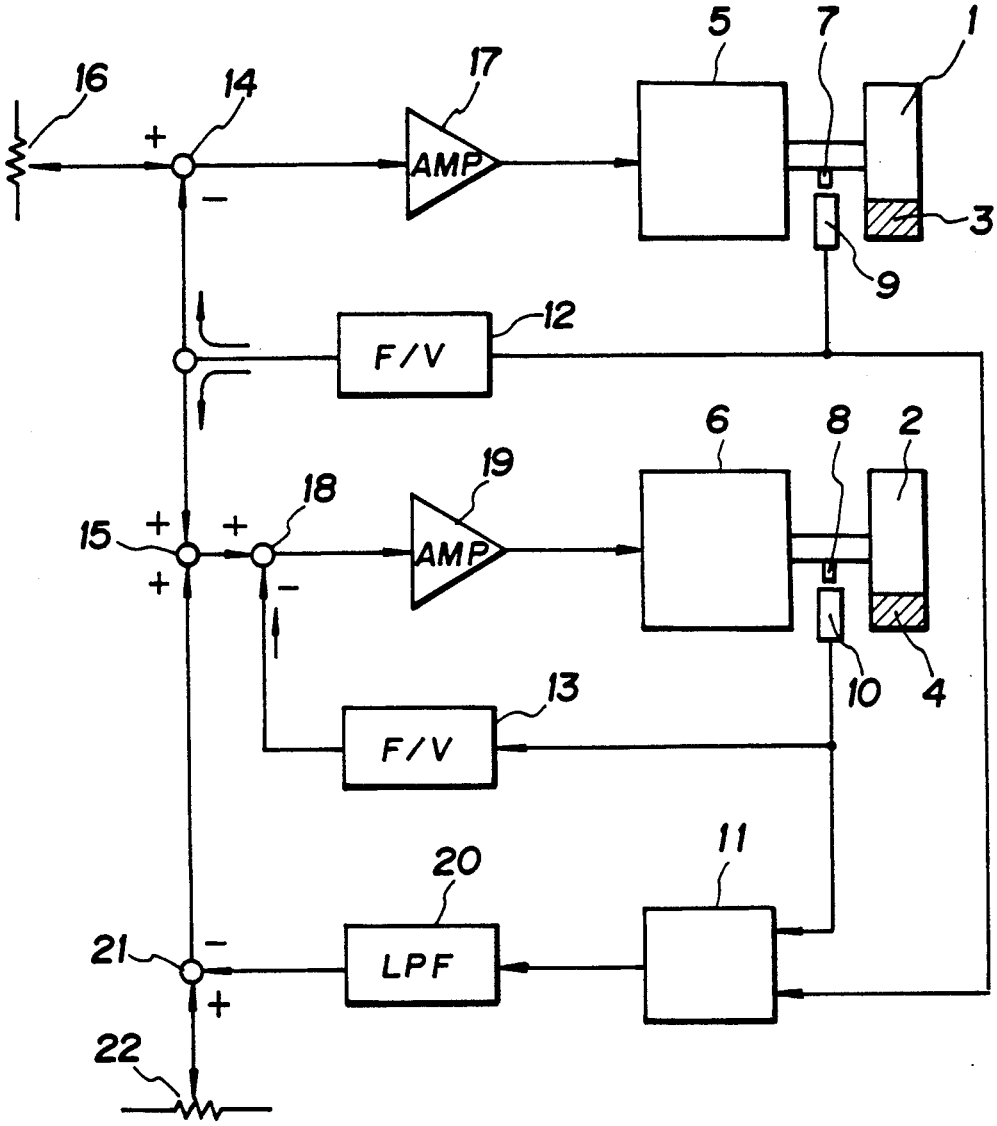
FIG. 2 is a circuit diagram of a relative phase difference regulator for the unbalanced weights in the embodiment of the vibration generator using rotary bodies having unbalanced weights according to the present invention.

In a vibration generator using rotary bodies having unbalanced weights, the coaxially opposed first and second rotary bodies 1, 2 are provided with unbalanced weights 3, 4 and adapted to be rotated by electric motors 5, 6 as shown in FIG. 1. Single-element members to be detected 7, 8 consisting of projections or marks are provided on suitable portions of rotating parts, for example, the electric motor shafts as shown in FIG. 2. The member to be detected 7 has a predetermined positional relationship with the weight 3, while the member to be detected 8 has a positional relationship with the weight 4 that is identical with the previously-mentioned predetermined positional relationship. For example, the first and second rotary bodies 1, 2 and unbalanced weights 3, 4 are all in an equiphase relation.

In this unbalanced weight-carrying vibration generator, the vibromotive force, i.e. the amplitude of vibration is set on the basis of a phase difference between the unbalanced weights 3, 4, and the vibration frequency on the basis of rotational speed thereof. The circuit of an amplitude regulator for the vibration generator, i.e. a relative phase difference regulator for the unbalanced weights is shown in FIG. 2.

Rotary detectors (electromagnetic pickups) 9, 10 are provided on the portions of a fixed part which are close to the members to be detected 7, 8. The output terminals of the rotary detectors 9, 10 are connected to a phase measuring element 11, and respectively to frequency/-voltage converters 12, 13.

The output terminal of the frequency/voltage converter 12 is connected to a subtractor 14 and an adder 15, the output terminal of a revolution number setter 16 is also connected to the subtractor 14, and the output terminal of the subtractor 14 is connected to the electric motor 5 through a control amplifier 17.

The output terminal of the frequency/voltage converter 13 is connected to a subtractor 18, the output terminal of the adder 15 is also connected to the subtractor 18, and the output terminal of the subtractor 18 is connected to the electric motor 6 through a control amplifier 19.

The output terminal of the phase measuring element 11 is connected to a subtractor 21 through a low-pass filter 20, and the output terminal of a phase angle setter 22 is also connected to the subtractor 21. The output terminal of the subtractor 21 is connected to the adder 15 to which the output terminal of the frequency/voltage converter 12 is connected.

Figure 4:
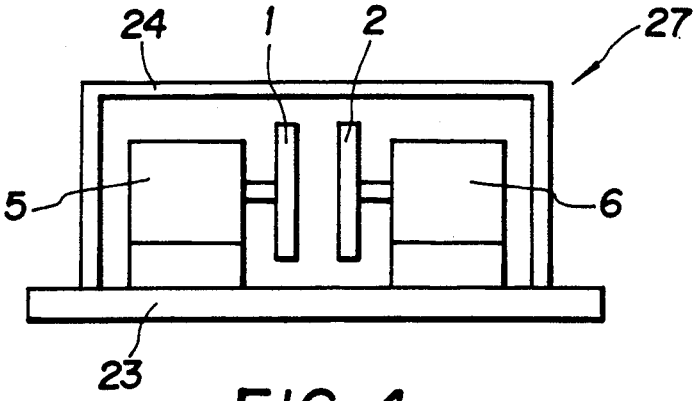
FIG. 4 is elevational view of an embodiment of a utilized vibration generator using rotary bodies having unbalanced weights according to the present invention.

The electric motor 5 to which the first rotary body 1 provided with the weight 3 is fixed, and the electric motor 6 to which the second rotary body 2 provided with the weight 4 is fixed in this vibration generator using rotary bodies having unbalanced weights, are mounted with the rotary bodies and weights thereon; in an opposed out of phase relation on a base plate 23 as shown in FIG. 4, and the resultant product is covered with a case 24 to form a unitized structure, which can be utilized by being installed in various types of machines and instruments.

The operation and effect of this vibration generator using rotary bodies having unbalanced weights will now be described.

A command voltage signal corresponding to the number of revolutions per unit time which is set by the number of revolutions setter 16 is amplified in the control amplifier 17 and inputted into the electric motor 5 to cause the electric motor 5, i.e. first rotary body 1 to be rotated at a speed corresponding to the signal. Every time the first rotary body 1 actually makes a full revolution, the fact is detected as a revolution of the member to be detected 7 by the rotation detector 9, and a one-pulse signal is outputted. This pulse signal is converted into a voltage signal in the frequency/voltage converter 12 and fed back to the subtractor 14. Accordingly, the number of revolutions per unit, i.e. the rotational speed of the electric motor 5, i.e. the first rotary body 1 is maintained accurately so that it agrees with the number of revolutions per unit time, i.e. rotational speed set by the number of revolutions setter 16.

The voltage signal based on the pulse signal representative of the detected number of revolutions of the member to be detected 7 and outputted from the frequency/voltage converter 12 is amplified by the control amplifier 19 and inputted into the electric motor 6, so that the electric motor 6, i.e. the second rotary body 2 is rotated in accordance with this signal and synchronously with the electric motor 5, i.e. the first rotary body 1.

Every time the second rotary body 2 actually makes a full revolution, the fact is detected as a revolution of the member to be detected 8 by the rotation detector 10, and a one-pulse signal is outputted. This pulse signal is converted into a voltage signal in the frequency/voltage converter 13 and fed back to the subtractor 18. Therefore, the number of revolutions of the second rotary body 2 is maintained accurately so that it agrees with that of the first rotary body 1.

The above-mentioned pulse signals representative of the rotations of the first and second rotary bodies 1, 2 and outputted from the rotation detectors 9, 10 are inputted into the phase measuring element 11 at different instants.

The member to be detected 7 has predetermined positional relationship with the weight 3, and the member to be detected 8 has a positional relationship with the weight 4 that is identical with the previously-mentioned positional relationship. Accordingly, in the phase measuring element 11, the phase difference between the two unbalanced weights 3, 4 is measured as time difference between the two pulse signals.

A signal outputted from the phase measuring element 11 and representative of the phase difference between the unbalanced weights 3, 4 is smoothed in the low-pass filter 20, and the smoothed phase difference signal, i.e. a voltage signal proportional to the phase difference is inputted as a feedback signal into the subtractor 21. A signal representative of a deviation of the phase difference fed back from that set by the phase angle setter 22 is inputted from the substractor 21 into the adder 15, and the electric motor 6 is controlled on the basis thereof.

As a result, the deviation of the phase of the weight 4 on the second rotary body 2 from that of the weight 3 on the first rotary body 1 is maintained so that it is in agreement with the phase difference set arbitrarily by the phase angle setter 22, and the second rotary body 2 is rotated synchronously.

Accordingly, the unbalanced weights 3, 4 on the first and second rotary bodies 1, 2 are rotated at a desired speed and with a desired phase difference by setting the levels, which are to be set by the number of revolutions setter 16 and phase angle setter 22, in a desired manner, whereby the vibration regulation utilizing the sum of vectors of the centrifugal force in the vibration generator using rotary bodies having unbalanced weights is carried out.

The examples of vibratory stimulating apparatuses utilizing the above embodiment of the vibration generator using rotary bodies having unbalanced weights are shown in FIGS. 5–8.

Figure 5:
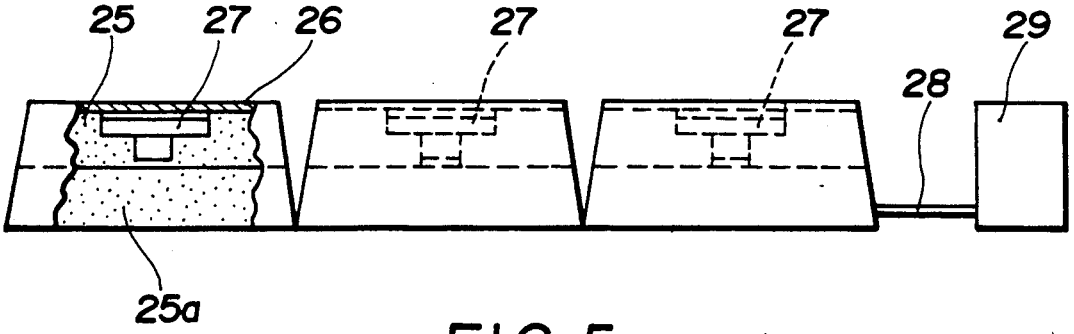
FIG. 5 is a partially cutaway view in side elevation of an embodiment of a mat type vibratory stimulating apparatus according to the present invention.

In the embodiment shown in FIG. 5, the vibration generator using rotary bodies having unbalanced weights is applied to a mat type vibratory stimulating apparatus.

The mat type vibratory stimulating apparatus is used by being laid on, for example, a straw mat, a thick bedquilt, a bed, a chair and a floor. The mat type vibratory stimulating apparatus according to the present invention contains laminated rectangular sponge members 25, 25*a*, and is formed foldably, an elastic plate 26 harder than the sponge member being provided on the upper surface of the upper sponge member. The upper member 25 is provided with a plurality of bottomed bores in each of which the vibration generator 27 described in the previous embodiment is set.

The vibratory apparatus is connected to a driving means 29, which consists of a phase difference computing element and a rotation controller, through the vibration generators 27 and a lead wire 28, and the vibration generators 27 are adapted to be vibrated with a frequency of, for example, 30–150 Hz.

In this embodiment, the vibration generators 27 are installed in the sponge member 25. The vibration generators 27 may be fixed detachably to such suitable portions of the upper surface of the sponge member 25 that are varied in accordance with the size of an object living body and the parts to be vibratorily stimulated of the living body, by using, for example, a surface-adhesive fastener.

The mat type vibratory stimulating apparatus thus formed is laid freely on, for example, a straw mat, a thick bedquilt, a carpet, a chair, a floor, and the ground surface to enable it to vibratorily stimulate a part or the whole of a living body. Such vibratory stimulation has a remarkable effect in relaxing the muscles of a living body, improving the circulation of the blood, shortening sleep latency, awaking a user, and relieving a pain in shoulder tightness, muscular pain, a pain in lumbago, arthritis and rheumatism and attacks thereof.

When a subject living body is healthy, this apparatus serves to promote the shortening of the sleep latency and also induce a sound sleep, and relax the body and gives the mind a sense of security.

Figure 6:
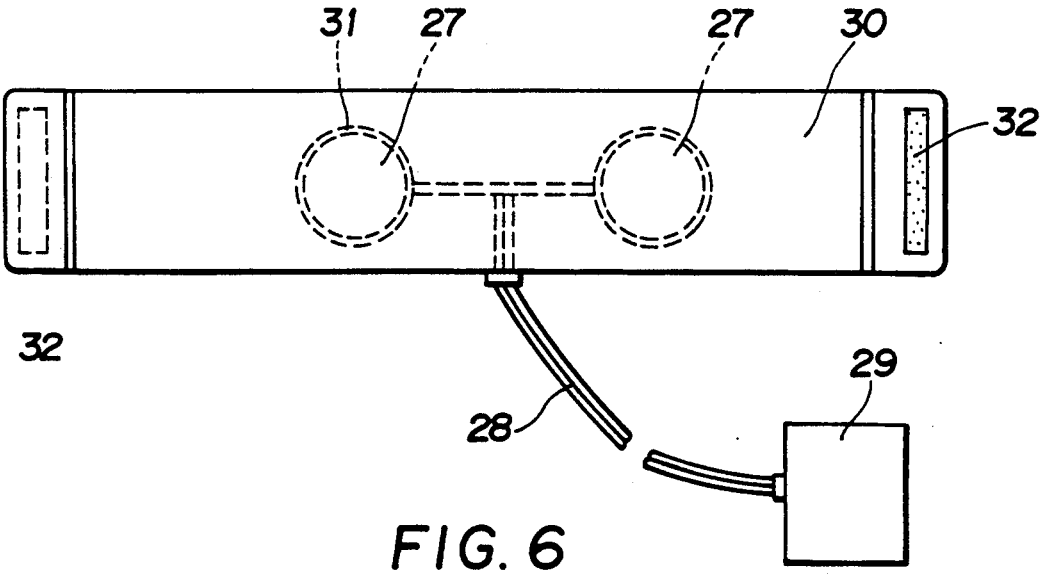
FIG. 6 is a front elevational view of an embodiment of a belt type vibratory stimulating apparatus according to the present invention.

An embodiment shown in FIG. 6 gives a belt type vibratory stimulating apparatus which has more than one vibration generator 27 housed in a belt member 30 and is used by being wrapped around the arm, leg or trunk of a living body. In the belt member 30, a resilient support member 31 which contains a vibration generator 27 therein is provided. At either end of the belt member, a fastener such as a surface adhesion fastener is attached, and the vibration generator 27 is connected via lead wires 28 to a driving unit 29.

The belt type vibratory stimulating apparatus according to this embodiment can be freely wrapped around the arm, leg or trunk of a living body for stimulation at a vibratory frequency of 30 to 150 Hz, so that the vibratory stimulation has a remarkable effect in relaxing the muscles of a living body, improving the circulation of the blood, shortening sleep latency, awaking a user, and relieving a pain in shoulder tightness, muscular pain, a pain of lumbago, arthritis and rheumatism and attacks thereof. A belt type vibratory stimulating apparatus has an effect in practicing a warmup and giving a massage before and after doing sports.

Figure 7:
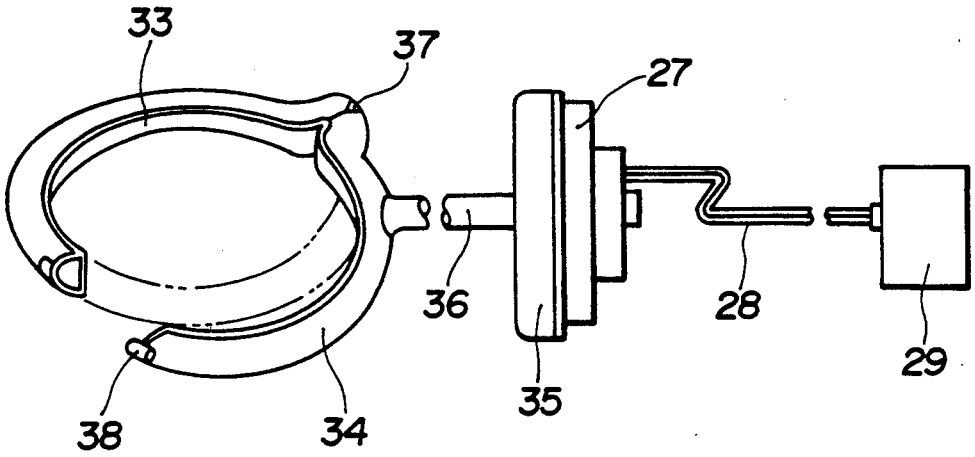
FIG. 7 is a schematic view in perspective of an embodiment of a vibratory chest and abdomen stimulating apparatus according to the present invention.

An embodiment shown in FIG. 7 is used to vibratorily stimulate the whole of the circumferences of the chest and abdomen of a living body. In this embodiment, an annular vibrating tube 34, which has a hard outer wall and an elastic inner circumferential vibrating wall 33, and a vibration generator 27 are connected together by a flexible tube 36 via a pressure chamber 35, and an oil is packed in the interior of the flexible tube 36 so that this oil propagates the vibration of the vibration generator 27 to cause the elastic vibrating wall 33 to be vibrated. The flexible tube 36 may also be filled with a liquid other than an oil, and a gas.

The annular vibrating tube 34 is divided into two arcuate portions, which are joined together via a pivot 37 so that these two arcuate portions can be displaced toward and away from each other, and the annular tube 34 can be retained in a closed state by a locking member 38.

This vibratory stimulating apparatus preferably has a structure which is, for example, capable of being expanded and contracted in accordance with the sizes of a living body and attached closely to even living bodies of different sizes.

In the case of treating a subject with asthma, who can exclusively use one vibratory stimulating apparatus, it is preferable to make the annular vibrating tube 34 so that it can be fitted around him or her as close as possible.

In order to use this vibratory stimulating apparatus, the annular vibrating tube 34 is fastened to the chest or abdomen of a living body, and the living body is then laid on a sofa. The vibration generator 27 is vibrated with a predetermined frequency, and the asthmatic attack can thus be relieved and stopped quickly.

Slightly different frequencies need to be applied to different living bodies. Accordingly, a standard frequency (for example, 65 Hz) may be initially applied to a living body to vibratorily stimulate the same, and an optimum frequency may then be selected while monitoring the symptom of the living body.

The vibratory stimulating apparatus in this embodiment has excellent effect in relieving and stopping an assthmatic attack, relieving a muscular pain in the chest and abdomen, relaxing and relieving the fatigue of muscles, improving the circulation of the blood and relieving lumbago.

When a subject living body is healthy, this apparatus serves to promote the shortening the sleep latency and induce a sound sleep, and relax the body and gives the mind a sense of security.

Figure 8:
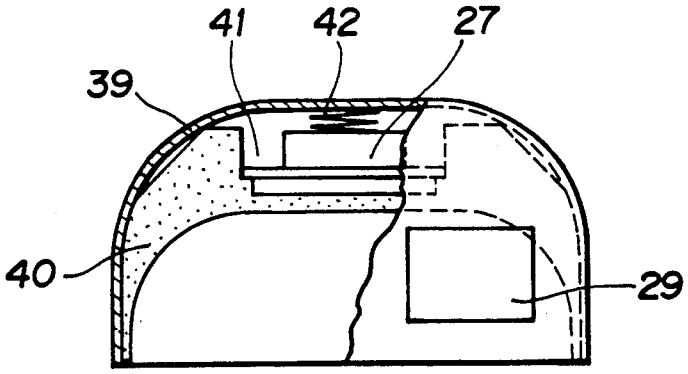
FIG. 8 is a partially cutaway and cross-sectional view in side elevation of an embodiment of a helmet type vibratory stimulating apparatus according to the present invention.

An embodiment shown in FIG. 8 is a helmet type vibratory stimulating apparatus used by being fitted around the head. A helmet member 39 is provided therein with a sponge member 40 having a recess the shape of which is in conformity with that of the head. In a vibration generator-setting bore 41 provided in the sponge member 40, a vibration generator 27 is inserted with its vibrating plate directed to an opening of the helmet member 39. The surface of the vibration generator 27 which is on the opposite side of the vibrating plate is supported resiliently on a spring 42 provided on the bottom wall of the helmet member 39. A driving means 29 for the vibration generator 27 is attached to a suitable portion of the outer surface of the helmet member 39, and the vibration generator 27 is adapted to be vibrated with a frequency of, for example, 100–150 Hz.

This helmet type vibratory stimulating apparatus is fitted around the head of a living body to vibratorily stimulate the scalp. The scalp is thus massaged, so that remarkable effects are produced in improving the circulation of the blood, shortening sleep latency, awaking a user, relieving a headache, relaxing the body and mind, promoting the growth and regeneration of hair and preventing fallen hair.

When a hair restorer, such as "Kankoh-so No. 301" (manufactured by the Japanese Research Institute for Photosensitizing Dyes Co. Ltd., Okayama, Japan) is applied to the scalp by hand so as to then vibratorily stimulate the scalp, a better hair growing and regenerating effect can be obtained.

The helmet type vibratory simulating apparatus has not only a sleep latency-shortening effect but also an awaking effect. Therefore, if a driver at work wears this apparatus, it serves a double purpose i.e., it prevents the driver from dozing at the wheel, and assures his careful driving. When this apparatus is used with a frequency of in the vicinity of 10 Hz, it produces an effect in convert the brain waves into the alpha waves.

In the vibration generator using rotary bodies having unbalanced weights according to the present invention, absolute encoders, which is provided in a conventional vibration generator of this kind for detecting and observing the phase of the unbalanced weights on the rotary bodies, are not used. In the vibration generator according to the present invention, the rotations of single-element members to be detected consisting of marks or projections are detected, and the phases of the unbalanced weights are detected by signals outputted in the form of pulses each of which represents one revolution of a weight. This enables the vibration generator to be miniaturized, and suitably applied to various kinds of apparatuses, for example, various types of vibratory stimulating apparatuses, such as a sound sleeping bed and a kneader. Moreover, the price of this vibration generator can be much reduced.

The present invention is not, of course, limited to the above embodiments; it may be modified in various ways within the scope of the appended claims.

We claim:

1. A vibration generator using rotary bodies having unbalanced weights, comprising:

two spaced non-contacting rotary bodies having unbalanced weights disposed in out of phase relation with respect to each other;

driving means for rotating said rotary bodies;

single-element detectable members on said rotary bodies in predetermined positional relation with respect to said rotary weights;

rotation detectors mounted in fixed positions proximate the loci of rotational movements of said detectable members and adapted to output pulse signals when detectable members pass a respective relative rotation detector, so that a pulse signal is outputted for each revolution of a rotary body;

phase difference computing means connected to said rotation detectors for computing a phase difference between said unbalanced weights on said two rotary bodies in response to said signals from said rotation detectors and outputting a phase difference signal; and rotation controlling means connected to said phase difference computing means and said rotary body driving means and adapted to control said rotary body driving means in response to said phase difference signal from said phase difference computing means so that said phase difference signal reaches a predetermined level.

2. The vibration generator as claimed in claim 1 and further comprising:

means for applying said vibration generator to a living body for vibrating and stimulating said living body.

3. The vibration generator as claimed in claim 2 wherein said applying means comprises;

a belt member;

means for attaching said belt member to a part of a living body; and means for mounting at least one vibration generator in said belt member so that vibrations produced thereby are conducted through said belt member to a body to which said belt member is attached.

4. The vibration generator as claimed in claim 2 wherein said applying means comprises:

a helmet member having an inside wall; and means for mounting at least one vibration generator on said inside wall so that vibrations produced thereby are conducted to a part of a living body with which said helmet member is engaged.

5. The vibration generator as claimed in claim 1 wherein:

said vibration generator produces vibration having a frequency in the range of 1 to 400 Hz.

6. The vibration generator as claimed in claim 2 wherein:

said vibration generator produces vibration having a frequency in the range of 1 to 400 Hz.

7. The vibration generator as claimed in claim 3 wherein:

said vibration generator produces vibration having a frequency in the range of 1 to 400 Hz.

8. The vibration generator as claimed in claim 4 wherein:

said vibration generator produces vibration having a frequency in the range of 1 to 400 Hz.

9. The vibration generator as claimed in claim 1 and further comprising means for applying said vibration generator to a surface comprising:

a flexible mat; and a plurality of said vibration generators mounted in relative spaced relationship in said mat so that vibrations produced by said vibration generators are conducted by said mat to the surface.

10. The vibration generator as claimed in claim 9 wherein:

said mat comprises a plurality of interconnected sponge elements; and a vibration generator is mounted in each sponge element.

11. The vibration generator as claimed in claim 10 wherein:

said sponge elements are laminated and substantially rectangular in shape.

12. The vibration generator as claimed in claim 1 wherein:

said rotary bodies rotate about a common axis of rotation.

13. The vibration generator as claimed in claim 12 wherein:

said rotary bodies are mounted on separate shafts having collinear axes of rotation.

14. The vibration generator as claimed in claim 13 wherein said driving means comprises:

electric motor means connected to said shafts for rotating said shafts.

15. The vibration generator as claimed in claim 14 wherein:

said electric motor means comprises separate electric motors for each shaft.

16. The vibration generator as claimed in claim 12 wherein:

said rotary bodies rotate at the same rotational speed.

17. The vibration generator as claimed in claim 12 wherein:

said rotary bodies rotate in the same direction.

18. The vibration generator as claimed in claim 16 wherein:

said rotary bodies rotate in the same direction.

19. The vibration generator as claimed in claim 13 wherein:

said rotary bodies rotate in the same direction.

20. The vibration generator as claimed in claim 19 wherein:

said rotary bodies rotate at the same rotational speed.

* * * * *